US010252731B2

(12) United States Patent
Hoetzendorfer

(10) Patent No.: US 10,252,731 B2
(45) Date of Patent: Apr. 9, 2019

(54) LOADING TRAIN FOR BULK MATERIAL

(71) Applicant: PLASSER & TEURER EXPORT VON BAHNBAUMASCHINEN GESELLSCHAFT M.B.H., Vienna (AT)

(72) Inventor: Patrick Hoetzendorfer, Engerwitzdorf (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 162 days.

(21) Appl. No.: 15/301,998

(22) PCT Filed: Mar. 13, 2015

(86) PCT No.: PCT/EP2015/000564
§ 371 (c)(1),
(2) Date: Oct. 5, 2016

(87) PCT Pub. No.: WO2015/154844
PCT Pub. Date: Oct. 15, 2015

(65) Prior Publication Data

US 2017/0120936 A1 May 4, 2017

(30) Foreign Application Priority Data

Apr. 7, 2014 (AT) ..... 153/2014 U

(51) Int. Cl.
*B61D 15/00* (2006.01)
*B61G 5/00* (2006.01)
(Continued)

(52) U.S. Cl.
CPC ..... *B61D 15/00* (2013.01); *B61D 3/00* (2013.01); *B61G 5/00* (2013.01); *E01B 27/00* (2013.01)

(58) Field of Classification Search
CPC ..... B61D 15/00; B61G 5/02
See application file for complete search history.

(56) References Cited

U.S. PATENT DOCUMENTS 4,191,107 A * 3/1980 Ferris ..... B60P 3/073 105/4.1
4,361,219 A * 11/1982 Aldridge ..... E21C 31/10 198/315
(Continued)

FOREIGN PATENT DOCUMENTS

DE 9316007 U1 1/1994
EP 0490310 A1 6/1992
(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A loading train (1) consists of at least two loading wagons (2, 3) for transporting and storing bulk material, each having a wagon frame (5) supported on on-track undercarriages (4), a storage box (6) with a bottom conveyor belt (8) which is situated in the bottom region of the storage box and extends in the longitudinal direction (7) of the wagon, and a pivotable transfer conveyor belt (9) adjoining the bottom conveyor belt (8) and projecting beyond the wagon frame (5). A tilt protection device (11) is provided between the frontmost, first loading wagon (3)—with regard to a transport direction (10) of the bottom conveyor belt (8)—and the following, second loading wagon (2). The tilt protection device (11) is designed for contacting the rearward wagon frame end of the first loading wagon (3) in order to block an upward movement of the wagon frame (5).

6 Claims, 2 Drawing Sheets

(51) Int. Cl.
*E01B 27/00* (2006.01)
*B61D 3/00* (2006.01)

(56) References Cited

U.S. PATENT DOCUMENTS 4,718,351 A * 1/1988 Engle ..... B61D 3/184 105/199.3
4,947,761 A * 8/1990 Engle ..... B61D 3/184 105/221.1
5,219,262 A 6/1993 Theurer et al.
5,221,172 A 6/1993 Theurer et al.
5,271,335 A * 12/1993 Bogenschutz ..... B61D 3/184 105/4.3
5,400,718 A * 3/1995 Theurer ..... B61D 7/06 104/2
5,944,469 A * 8/1999 Theurer ..... E01B 27/00 213/62 R
5,993,130 A * 11/1999 Theurer ..... B61D 15/00 414/339
5,993,131 A * 11/1999 Theurer ..... B61D 15/00 104/2
6,892,648 B2 * 5/2005 Theurer ..... B61D 7/32 104/5
7,192,238 B2 * 3/2007 Theurer ..... B61D 7/32 104/2

FOREIGN PATENT DOCUMENTS

EP 0490868 A1 6/1992
EP 2087173 B1 6/2011
WO WO-2008052230 A1 * 5/2008 ..... E01B 27/00

* cited by examiner

LOADING TRAIN FOR BULK MATERIAL

BACKGROUND OF THE INVENTION

Field of the Invention

The invention relates to a loading train consisting of at least two loading wagons for transporting and storing bulk material, each having a wagon frame supported on on-track undercarriages, a storage box with a bottom conveyor belt which is situated in the bottom region of the storage box and extends in the longitudinal direction of the wagon, and a pivotable transfer conveyor belt adjoining the bottom conveyor belt and projecting beyond the wagon frame.

A loading train or loading wagons of this type are already known from EP 0 490 310 A1 or DE 93 16 007 U1. These are equipped with devices for increasing stability. Said devices consist of a blocking apparatus for the transfer conveyor belt or of vertically adjustable supports resting on the ballast bed. With this, an overturning of the loading wagon is avoided.

EP 2 087 173 B1 discloses a track maintenance machine, the frame of which includes a joint. In order to be able to keep the frame torsion-free, a device for stabilising the machine frame is arranged in the region of the joint.

BRIEF SUMMARY OF THE INVENTION

It is the object of the present invention to provide a loading train of the type mentioned at the beginning with which a particularly safe unloading operation is possible.

According to the invention, this object is achieved with a loading train of the specified kind by way of the features cited in the characterizing part of the main claim.

A loading train configured in this manner can be unloaded without hesitation even under exceptional conditions. The super-elevation in a track curve, or a transfer conveyor belt which is maximally pivoted transversely to the longitudinal direction of the wagon for unloading, can cause an instability of the front-most loading wagon and, in the extreme case, even a tipping over, along with all the possible negative consequences for the entire loading train. Due to the arrangement of a tilt protection device according to the invention, a tilting moment occurring at the front-most loading wagon is absorbed by the tilt protection device. A danger situation, i.e. an upward motion of the wagon frame of the front-most loading wagon, is immediately counteracted by deployment of the tilt protection device, by which a stable state of equilibrium is promptly attained again.

Additional advantages of the invention become apparent from the dependent claims and the drawing description.

BRIEF DESCRIPTION OF THE SEVERAL VIEWS OF THE DRAWING

The invention will be described in more detail below with reference to embodiments represented in the drawing.

DESCRIPTION OF THE INVENTION

Figure 1:
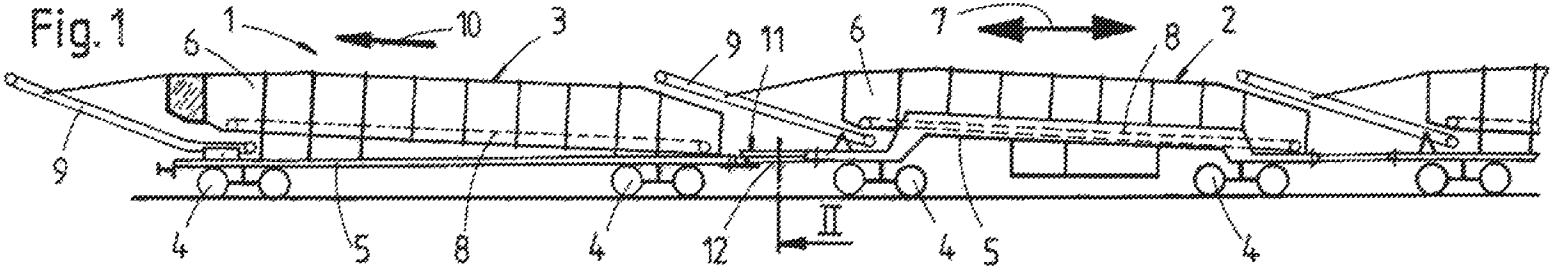
FIG. 1 shows a schematic side view of a loading train.

A loading train 1, shown schematically in FIG. 1, consists of at least two loading wagons 2, 3 for transporting and storing bulk material. Each loading wagon 2, 3 is essentially composed of a wagon frame 5 which is supported on on-track undercarriages 4 and has a storage box 6. Located in the bottom region of the storage box 6 is a bottom conveyor belt 8 extending in the longitudinal direction 7 of the wagon, and a pivotable transfer conveyor belt 9 adjoining the bottom conveyor belt 8 and projecting beyond the wagon frame 5 is arranged for passing bulk material on to a further loading wagon 3. A tilt protection device 11 is provided between the front-most, first loading wagon 3—with regard to a transport direction 10 of the bottom conveyor belt 8—and the following, second loading wagon 2. The loading wagons 2, 3 are connected to one another by a coupling 12.

The tilt protection device 11, which has a front and a rear end 13, 14 (FIGS. 3 and 4)—with regard to the longitudinal direction 7 of the wagon—is fastened with the rear end 14 to the second loading wagon 2. The front end 13 of the tilt protection device 11 is designed for contacting a rearward wagon frame end 15 of the first loading wagon 3, or for detachable connection to the wagon frame end 15, in order to block an upward movement of the wagon frame 5.

Figure 3:
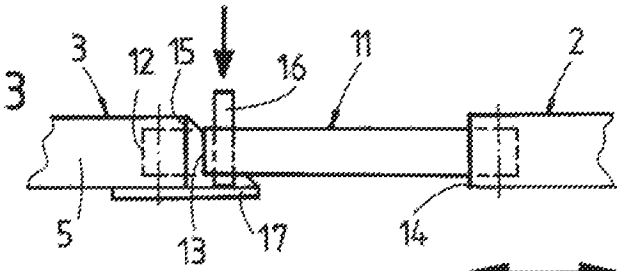
Figure 2:
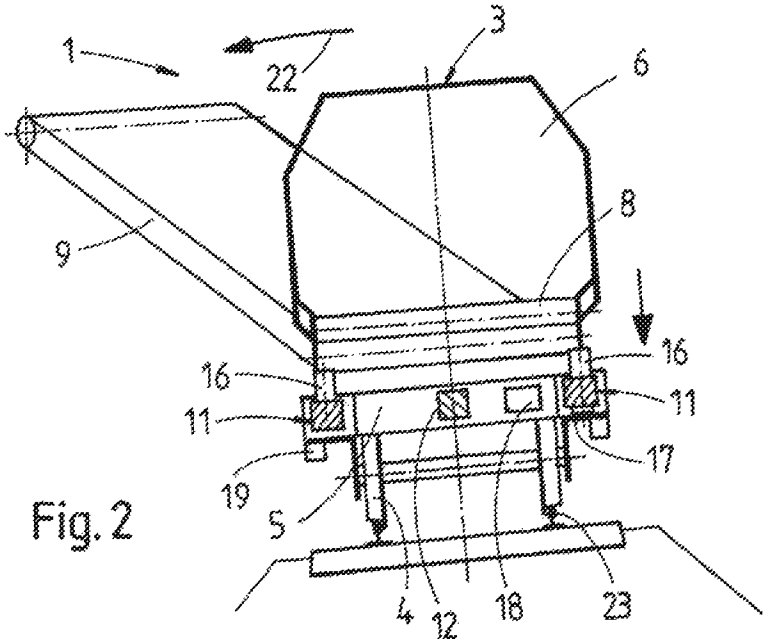
FIG. 2 shows an enlarged cross-section of the loading train along the line II in FIG. 1, and FIGS. 3 to 5 show detail views of tilt protection devices.

As shown in FIGS. 2 and 3, the front end 13 of the tilt protection device 11 is configured for resting on the rearward wagon frame end 15 of the first loading wagon 3. At the front end 13, the tilt protection device 11 has a support ram 16, adjustable in vertical direction, for placement on the rearward wagon frame end 15 of the first loading wagon 3. In an expedient manner, the supporting takes place on a support plate 17 attached to the wagon frame 5. The support rams 16 are advantageously designed as hydraulic cylinders; alternatively, an embodiment in the shape of a spring element would also be conceivable.

The tilt protection device 11 is connected to a control device 18 which is connected to measuring implements 19 for detecting a tilting motion of the front-most loading wagon 3.

Figure 4:
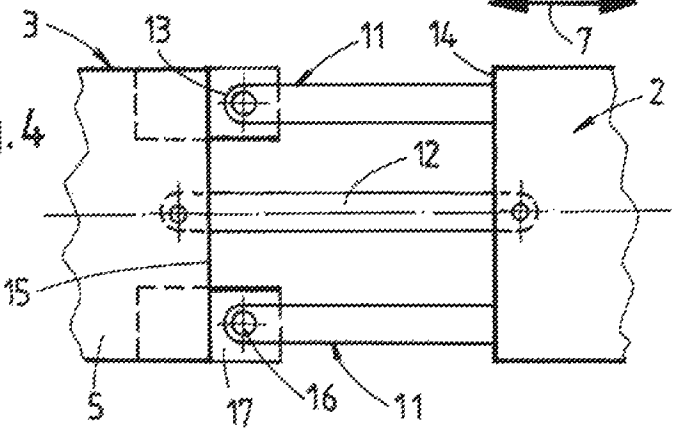

As can be seen mainly in FIG. 4, two tilt protection devices 11 are provided, spaced from one another in a transverse direction of the wagon extending perpendicularly to the longitudinal direction of the wagon.

Figure 5:
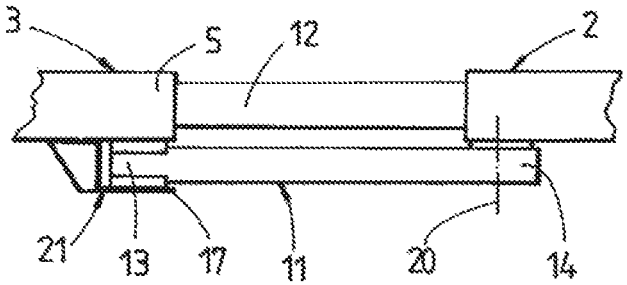

The tilt protection device 11 visible in FIG. 5 is fastened to the second loading wagon 2 for pivoting about a vertical axis 20. Due to the support plate 17 which, in this embodiment, is mounted underneath the wagon frame 5 of the loading wagon 3, a form-fitting connection 21 between the two loading wagons 2, 3 ensues.

The mode of function of the tilt protection device 11 will be described in more detail below. FIG. 2 shows the front-most loading wagon 3 with the transfer conveyor belt 9 pivoted far to the side. Since the loading wagon 3 is furthermore situated in a track curve, it is already in an inclined position due to the curve super-elevation. The weight of the bulk material to be discharged causes an additional load. This results in a tilting moment (arrow 22) due to which the wagon frame 5 first undergoes an upward movement, and then the loading wagon 3 could lift off from an outer rail 23 of the track curve and topple over. In order to compensate the tilting moment and keep the loading wagon 3 in balance, the tilt protection device 11 located above the outer rail 23 is actuated. The hydraulic cylinder acts upon the wagon frame 5 of the loading wagon 3 via the support plate 17 and thus prevents the loading wagon 3 from lifting off the rail 23. If unloading takes place towards the other side, the opposite tilt protection device 11 is employed in the same manner.

Due to the already described use of the control—and measuring devices 18, 19, the registering of the tilting moment and the actuation of the tilt protection devices 11 can be largely automatized, as a result of which it is possible to reliably preclude any handling errors.

In closing, it is pointed out that the tilt protection device 11 could also be fastened to the wagon frame end 15 of the first loading wagon 3. In this alternative, the required contacting or the detachable connection takes place with the rear end 14 of the tilt protection device 11 at the wagon frame 5 of the second loading wagon 2.

The invention claimed is:

1. A loading train, comprising:

at least two loading wagons for transporting and storing bulk material, each of said loading wagons having on-track undercarriages, a wagon frame supported on said on-track undercarriages and having a rearward wagon frame end, a storage box with a bottom conveyor belt situated in a bottom region of said storage box and extending in a longitudinal direction of a respective loading wagon of said loading wagons, and a pivotable transfer conveyor belt adjoining said bottom conveyor belt and projecting beyond said wagon frame; and a coupling connecting said at least two loading wagons to one another;

a tilt protection device separate from said coupling and disposed between a front-most, first loading wagon of said two loading wagons, with regard to a transport direction of said bottom conveyor belt, and a following, second loading wagon of said two loading wagons, said tilt protection device having a front end and a rear end, and with regard to the longitudinal direction of said respective loading wagon, said tilt protection device being fastened with said rear end to said second loading wagon, said front end of said tilt protection device is configured for contacting said rearward wagon frame end of said first loading wagon in order to block an upward movement of said wagon frame.

2. The loading train according to claim 1, wherein said front end of said tilt protection device is configured for detachable connection to said rearward wagon frame end of said first loading wagon.

3. The loading train according to claim 1, wherein said front end of said tilt protection device is configured for placement on said rearward wagon frame end of said first loading wagon.

4. The loading train according to claim 3, wherein said tilt protection device has, at said front end, a support ram adjustable in a vertical direction for placement on said rearward wagon frame end of said first loading wagon.

5. The loading train according to claim 1, wherein said tilt protection device is fastened to said second loading wagon for pivoting about a vertical axis.

6. The loading train according to claim 1, wherein said tilt protection device is one of two tilt protection devices spaced from one another and disposed in a transverse direction of said respective loading wagon extending perpendicularly to the longitudinal direction of said respective loading wagon.

* * * * *